US008978400B2

(12) United States Patent
Dunn et al.

(10) Patent No.: US 8,978,400 B2
(45) Date of Patent: Mar. 17, 2015

(54) AIR COOLED HELIUM COMPRESSOR

(75) Inventors: Stephen Dunn, Allentown, PA (US); Ralph Longsworth, Allentown, PA (US)

(73) Assignee: Sumitomo (Shi) Cryogenics of America Inc., Allentown, PA (US)

( * ) Notice: Subject to any disclaimer, the term of this patent is extended or adjusted under 35 U.S.C. 154(b) by 717 days.

(21) Appl. No.: 12/832,438

(22) Filed: Jul. 8, 2010

(65) Prior Publication Data

US 2011/0107790 A1 May 12, 2011

Related U.S. Application Data

(63) Continuation-in-part of application No. 12/614,539, filed on Nov. 9, 2009, now abandoned.

(51) Int. Cl.
*F25B 31/00* (2006.01)
*F04B 39/06* (2006.01)

(52) U.S. Cl.
CPC ..... *F04B 39/06* (2013.01)
USPC ..... 62/193; 62/196.1; 62/507; 62/6; 62/469; 62/84

(58) Field of Classification Search
USPC ..... 62/507, 84, 6, 193, 196.1, 505, 469, 62/468; 96/155; 417/313; 418/84
See application file for complete search history.

(56) References Cited

U.S. PATENT DOCUMENTS 2,906,101 A 9/1959 McMahon et al.
4,475,876 A * 10/1984 Olen ..... 418/84
4,693,736 A * 9/1987 Klusmier ..... 62/6
4,831,828 A * 5/1989 Klusmier et al. ..... 62/6
4,949,546 A * 8/1990 Klusmier et al. ..... 62/6
4,967,572 A * 11/1990 Strasser ..... 62/467
5,553,460 A 9/1996 Isaacs
6,017,205 A 1/2000 Weatherston et al.
6,488,120 B1 * 12/2002 Longsworth ..... 184/6.17
6,554,103 B2 * 4/2003 Longsworth ..... 184/6.17
7,077,776 B2 * 7/2006 Sorab et al. ..... 475/161
7,296,436 B2 * 11/2007 Dekiya ..... 62/468
2007/0253854 A1 11/2007 Dunn

OTHER PUBLICATIONS

R. C. Longsworth. "Helium Compressors for GM and Pulse-Tube Expanders" Advances in Cryogenic Engineering, vol. 47, American Inst. of Physics, 2002, pp. 691-698.

* cited by examiner

*Primary Examiner* — Mohammad M Ali
*Assistant Examiner* — Raheena Rehman
(74) *Attorney, Agent, or Firm* — Katten Muchin Rosenman LLP

(57) ABSTRACT

This invention relates generally to oil lubricated helium compressor units for use in cryogenic refrigeration systems, operating on the Gifford McMahon (GM) cycle. The objective of this invention is to keep the oil separator and absorber, which are components in an oil lubricated, helium compressor, in an indoor air conditioned environment while rejecting at least 65% of the heat from the compressor outdoors during the summer. The balance of the heat is rejected to either the indoor air conditioned air, or cooling water. This is accomplished by circulating hot oil at high pressure to an outdoor air cooled heat exchanger and returning cooled oil to the compressor inlet, while hot high pressure helium is cooled in an air or water cooled heat exchanger in an indoor assembly that includes the compressor, an oil separator, an oil absorber, and other piping and control components. It is an option to reject the heat from the oil to the indoor space during the winter to save on the cost of heating the indoor space.

11 Claims, 6 Drawing Sheets

AIR COOLED HELIUM COMPRESSOR

This invention relates generally to helium compressor units for use in cryogenic refrigeration systems, operating on the Gifford McMahon (GM) cycle. More particularly, the invention relates to a means of air cooling the compressor that has ecological and economic benefits.

BACKGROUND OF THE INVENTION

The basic principal of operation of a GM cycle refrigerator is described in U.S. Pat. No. 2,906,101 to McMahon, et al. The GM cycle has become the dominant means of producing cryogenic temperatures in small commercial refrigerators primarily because it can utilize mass produced oil-lubricated air-conditioning compressors to build reliable, long life, refrigerators at minimal cost. GM cycle refrigerators operate well at pressures and power inputs within the design limits of air-conditioning compressors, even though helium is substituted for the design refrigerants. Typically, GM refrigerators operate at a high pressure (Ph) of about 2 MPa (300 pounds per square inch absolute, psia), and a low pressure of about 0.8 MPa (117 psia). The cold expander in a GM refrigerator is typically separated from the compressor by 5 m to 20 m long gas lines. The expanders and compressors are usually mounted indoors and the compressor is usually cooled by water, most frequently water that is circulated by a water chiller unit. Some compressors are air cooled, mounted indoors and cooled by air conditioned air, or mounted outdoors and cooled by outdoor air.

Air-conditioning compressors are built in a wide range of sizes and several different designs. Means of providing additional cooling to adapt these compressors to compressing helium are different for different compressors. For example, compressors that draw approximately 200 to 600 W are typically reciprocating piston types which are cooled by adding air cooled fins to the compressor shell. Between about 800 to 4,500 W, the most common compressor is a rolling piston type with low pressure return gas flowing directly onto the compression chamber. In rolling piston compressors, oil flows into the compression chamber along with the helium and absorbs heat from the helium as it is being compressed. Most of the oil separates from the helium in the compressor shell which is at high pressure. U.S. Pat. No. 6,488,120 to Longsworth describes the cooling of helium, oil, and the compressor shell by wrapping a water cooling tube around the shell, and further wrapping a helium cooling tube and an oil cooling tube over the water tube. Cooled oil is then injected into the return helium line. In effect, the compressor serves as an oil pump. Scroll compressors that draw between 3,000 W and 15,000 W, and screw compressor that draw between 15 kW and 50 kW have been used for compressing helium, but at present the largest GM cycle refrigerators draw about 15 kW. The small reciprocating compressor has intake and exhaust valves and the rolling piston compressor compressor has a discharge valve. These valves limit the flow rate of oil that can be tolerated to flow with the oil to about 0.5% of the displacement while the scroll and screw compressors that don't have valves can pump oil that is typically about 2% of the displacement. This is sufficient to absorb about 75% of the heat from the compressor while the balance flows into the helium. Both streams flow from the compressor to be cooled external to the compressor and there is no need to remove heat from the compressor shell as is done with the smaller compressors that have valves.

Published patent application US 2007/0253854 describes a horizontal scroll compressor manufactured by Copeland Corp. which has been adapted by the same assignee as this application for compressing helium. The adaptation to flowing several times as much oil as is needed for air-conditioning refrigerants is done by having the excess oil by-pass the motor and flow directly into the scroll inlet. The Copeland compressor requires an external bulk oil separator to remove most of the oil from the helium. Heat is removed from the oil and helium in a water cooled heat exchanger, the oil is returned to the compressor and the helium passes through a second oil separator and an adsorber before flowing to the expander.

Prior art for converting this to being air cooled would replace the water cooled heat exchanger with an air cooled heat exchanger as shown in FIG. 1. This works acceptably well if the compressor is in an indoor air-conditioned environment where the air temperature is between 15° C. and 30° C. Experience has shown that heat loads of up to about 3 kW are acceptable for end users but for larger heat loads it is preferred to reject the heat to outdoor air if cooling water is not available. Designing a helium compressor to operate in an outdoor environment where temperatures can range from −30° C. to +45° C. present many challenges. The oil circulation rate is set high enough to keep the maximum discharge temperature below about 85° C. This is within an acceptable limit for the compressor but oil outgases contaminants that are adsorbed in it, principally water vapor, at a higher rate than lower temperature oil. This loads the adsorber faster and necessitates more frequent replacement of the adsorber. At low outdoor temperatures the oil becomes very viscous and makes starting the compressor difficult. This problem has been solved in the past by putting the compressor in a small shed that has adjustable louvers and a fan both of which are thermostatically controlled to keep the shed near room temperature. One or both of these features can also be incorporated in the compressor cabinet. A heater is needed to warm up the compressor before it is turned on, then the heat from the compressor keeps the shed or cabinet warm. The assignees of this application manufacture helium air-cooled compressors for operation indoors, Model CSA-71, which uses an Hitachi scroll compressor, and operation outdoors, Model CNA-61, which uses a Sanyo rolling-piston compressor. Both use prior art cooling means.

The Hitachi Corporation makes several models of scroll compressors that have been adapted to compressing helium. They draw between 5 and 9 kW. The Hitachi scroll compressors differ from the horizontal Copeland compressor in being oriented vertically and having return gas and oil flow through separate lines directly into the scroll. Helium and oil together are discharged into the shell at high pressure. Most of the oil separates from the helium and collects in the bottom of the compressor, similar to the rolling piston compressor described above. Unlike the smaller compressors, for this type of compressor, cooling the shell with a water cooling tube wrapped around it is not effective. Here, heat from the helium and oil is removed by an after-cooler that is external to the compressor shell, which is either air or water cooled. The Hitachi scroll is used to illustrate the principals of this invention because it does not need a separate bulk oil separator and the piping circuit is thus simpler.

SUMMARY OF THE INVENTION

The objective of this invention is to keep the oil separator(s) and adsorber, which are components in an air cooled, oil lubricated, helium compressor, in an indoor air conditioned environment while rejecting most of the heat from the compressor outdoors during the summer. The present invention is designed to be used with a GM or Pulse Tube cycle cryogenic refrigerator and will reject at least 65% of the heat produced by the compressor to outdoor air during the summer, with the balance being rejected to the indoor air conditioned air. This is accomplished by circulating hot oil at high pressure to an outdoor air cooled heat exchanger and returning cooled oil to the compressor inlet, while hot high pressure helium is cooled in an air cooled heat exchanger in an indoor assembly that includes the compressor, one or more oil separators, an oil adsorber, and other piping and control components.

It is a further objective to offer the option of rejecting the heat from the oil to the indoor space during the winter to save on the cost of heating the indoor space.

This invention will probably be favored for compressor systems that draw between about 4 to 12 kW and will reject about 1 to 3 kW of heat into air conditioned space in the summer.

BRIEF DESCRIPTION OF THE DRAWING

FIG. 2A also includes a helium/oil heat exchanger 11 which minimizes the amount of heat transferred to the indoor air by cooler 12.

DESCRIPTION OF THE PREFERRED EMBODIMENTS

Figure 1:
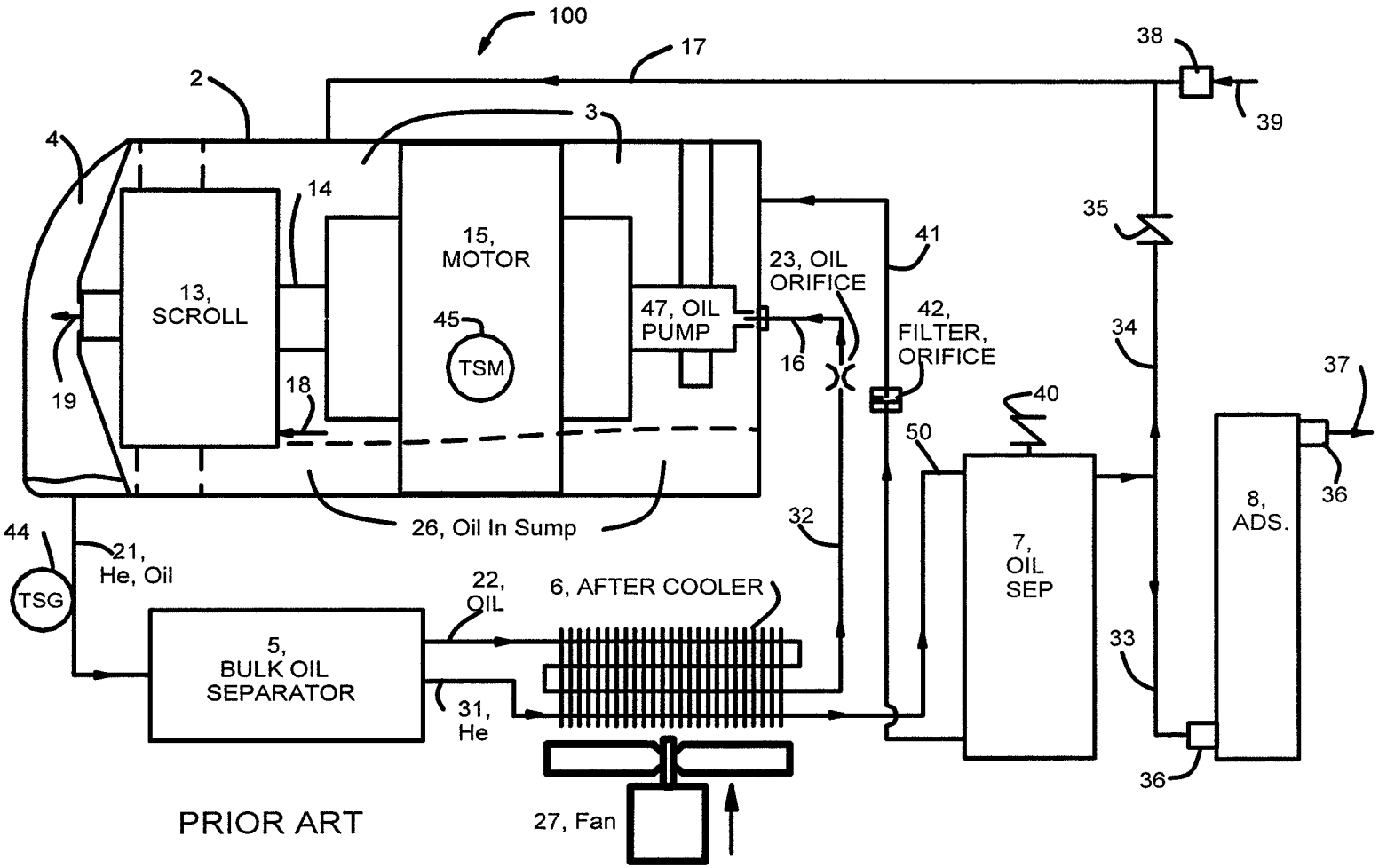
PRIOR ART FIG. 1
FIG. 1 is a schematic diagram of an oil-lubricated helium compressor system that would use prior art to replace the standard water cooled after-cooler with the air cooled after-cooler shown as 6 with fan 27.

Parts that are the same or similar in the drawings have the same numbers and descriptions are usually not repeated. FIG. 1 is a schematic diagram of an oil-lubricated helium compressor system that is presently being manufactured by the assignee of this invention except that after-cooler 6 is water cooled rather than air cooled. It shows a horizontal scroll compressor manufactured by Copeland Corp. which requires bulk oil separator 5 connected to compressor discharge line 21 to separate most of the oil from the helium. Subsequent drawings use the vertical scroll compressor manufactured by Hitachi to illustrate the compressor because the helium/oil mixture is discharged from the scroll into the compressor shell, which serves as a bulk oil separator.

Compressor system components that are common to all of the figures are: compressor shell 2, high pressure volume 4 in the shell, oil separator 7, adsorber 8, compressor scroll 13, drive shaft 14, motor 15, oil return port 16, helium return line 17, helium/oil mixture discharge from the scroll 19, high pressure hot oil line 22 to an after-cooler, oil flow control orifice 23, oil in the compressor sump, high pressure helium to an air cooled after-cooler 31, high pressure oil 32 from cooler 6 or 9, gas line 33 from oil separator 7 to adsorber 8, gas line 34 from oil separator 7 to internal relief valve (IRV) 35, adsorber gas couplings 36, high pressure helium gas supply line 37 that connects the compressor to the expander (not shown), return gas coupling 38 that connects gas returning from the expander at low pressure through line 39 to the compressor, atmospheric relief valve (ARV) 40, oil return line 41 from separator 7 to the compressor through orifice/filter 42, oil pump 47 which is integral to drive shaft 14, and line 50 that connects helium from the after-cooler to oil separator 7.

Compressor system 100 in FIG. 1 shows the conventional way of converting a water cooled unit to an air cooled unit by replacing the water cooled after-cooler with an air cooled after-cooler 6 and fan 27, and mounting the entire system outdoors. The oil flow rate is set to keep the maximum temperature at an acceptable value and the heat exchanger and fan are sized to reject the heat from the oil and helium at a maximum air temperature of about 45 C. Helium will flow to oil separator 7 at about 5° C. Unless there is a mechanism to cool it closer to room temperature, about 25 C, it will carry a high rate of contaminants, mostly water, that outgas from the hot oil, and collect in the adsorber. The adsorber thus needs to be replaced more frequently than if the compressor, helium after-cooler, oil separator(s), and adsorber are kept in an air conditioned environment per the present invention.

Compressor system 100 has the following differences from subsequent systems; return gas flows from line 17 into the shell of the compressor on the inlet side of the scroll thus most of the volume in shell 2 is at low pressure, 3. Oil in sump 26 is at low pressure and mixes with low pressure helium as it flows into the scroll at 18. Discharge line 21 contains the same helium/oil mixture that leaves the scroll, 19. FIG. 1 shows TSG 44 which is a temperature switch that shuts down the compressor if the discharge temperature is too high. TSM 45 is a temperature switch that shuts down the compressor if the motor temperature is too high. Most compressor systems have these two protectors.

Figure 2A:
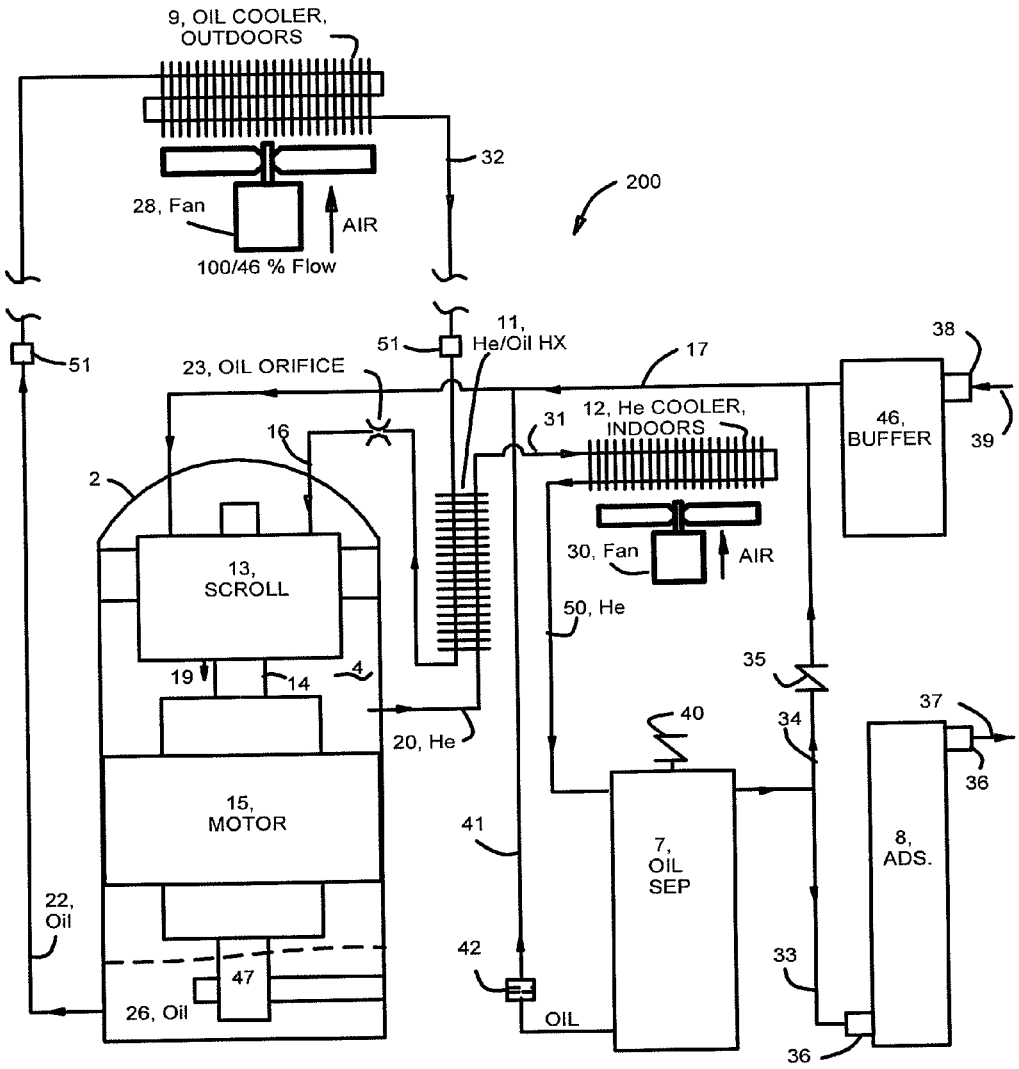
FIG. 2A is a schematic diagram of a compressor system in which oil is circulated to an air cooled oil-cooler 9 that is mounted outdoors while the rest of the system, including an air cooled helium-cooler 12, is located indoors in accordance with the present invention.

FIG. 2A is a schematic diagram of compressor system 200. It shows a vertical Hitachi compressor which is constructed such that helium returning through line 17 flows directly into scroll 13 as does the return oil through line 16. A mixture of hot compressed helium and oil exit from the scroll, 19, and most of the oil drops to sump 26 in the bottom of the compressor. Hot compressed helium with a small amount of oil exits the compressor through line 20 into heat exchanger 11, which transfers some of the heat from the hot helium to the returning oil. Helium then flows through helium cooler 12 which is cooled by indoor air driven by fan 30. Most of the heat from the compressor is rejected outdoors in oil-cooler 9.

Table 1 provides an estimate of the temperatures of the helium and oil in the systems shown in the figures for a summer outdoor temperature of 45° C. and a winter temperature of −30° C. Indoor temperatures are assumed to be 27° C. in the summer and 21° C. in the winter. The oil circulation rate is set by fixed orifice 23 to limit the maximum oil temperature in line 22 to be 85° C. It is assumed that this flow rate remains the same at lower ambient temperatures but in reality the flow rate drops with temperature. The calculations are done for a scroll compressor operating at 60 hz that has a displacement of 98 mL and draws 8.0 kW of power when compressing helium from 0.9 MPa to 2.3 MPa. The fan speeds are assumed to be variable so, for example, the outdoor air flow is reduced in the winter to prevent the oil from getting too cold. Lines to the outdoor heat exchanger are assumed to be insulated.

TABLE 1

| | Outdoor T - C. | | | | | | | | |
|---|---|---|---|---|---|---|---|---|---|
| | 45 | −30.0 | 45 | −30.0 | 45 | −30.0 | −30.0 | −30.0 | −30.0 |
| | Indoor T - C. | | | | | | | | |
| | 27 | 21 | 27 | 21 | 27 | 21 | 21 | 21 | 21 |
| FIG. | 1 | 1 | 2A | 2A | 2B | 2B | 3A | 3B | 4 |
| System | 100 | 100 | 200 | 200 | 201 | 201 | 300 | 301 | 400 |
| Helium | Summer | Winter | Summer | Winter | Summer | Winter | Winter | Winter | Winter |
| T20, compr out - C. | | | 85 | 70 | 85 | 70 | 70 | 70 | 70 |
| T31 HX in - C. | 85 | 68 | 60 | 38 | 85 | 68 | 38 | 38 | 38 |
| T50, HX out - C. | 50 | 33 | 32 | 24 | 32 | 24 | 24 | 24 | 24 |
| T37, Ads out - C. | 50 | 33 | 32 | 24 | 32 | 24 | 24 | 24 | 24 |
| T17, return line - C. | 27 | 21 | 27 | 21 | 27 | 21 | 21 | 21 | 21 |
| Oil | | | | | | | | | |
| T22, cmpr out - C. | 85 | 70 | 85 | 70 | 85 | 70 | 70 | 70 | 70 |
| T32, cooler out - C. | 53 | 38 | 53 | 37 | 59 | 42 | 34 | 34 | −7 |
| T43, He/oil HX in - C. | 53 | 38 | 53 | 37 | 59 | 42 | 34 | 34 | 20 |
| T16, compr in - C. | 53 | 38 | 59 | 40 | 59 | 42 | 42 | 42 | 38 |
| Heat to Indoors - % | 0 | 0 | 19 | 11 | 34 | 30 | 100 | 100 | 21 |
| Vol Oil/Disp Vol - % | 2.0 | 2.0 | 2.1 | 2.1 | 2.1 | 2.1 | 2.1 | 2.1 | 2.2 |
| Outdoor Fan Speed - % | 100 | 20 | 100 | 20 | 100 | 21 | Off | Off | 11 |
| Oil By-Pass - % | | | | | | | | | 60 |

Helium, and the other monatomic gases, get much hotter than other gases when being compressed, so the oil that is injected with the helium at the compressor inlet is substantial. Table 1 shows that that for system 100 the volume of oil that is injected occupies 2.0% of the displaced volume for this example. System 100, which represents prior art, rejects 100% of the compressor heat outdoors. System 200, which illustrate the present invention, rejects 81% of the heat outdoors, 19% indoors, on the hottest day assumed, and 89% of the heat outdoors, 11% indoors, on the coldest day assumed. For the 8.0 kW of input power used in this example the maximum heat load on the air conditioning system is 1.5 kW.

The most important aspect of this invention is that keeping all of the compressor system indoors, except the oil-cooler, results in the helium flowing through separator 7 and adsorber 8 to be much cooler than for system 100. Table 1 shows the helium out of the adsorber to be 32° C. for system 200 compared with 50° C. for system 100.

Figure 2B:
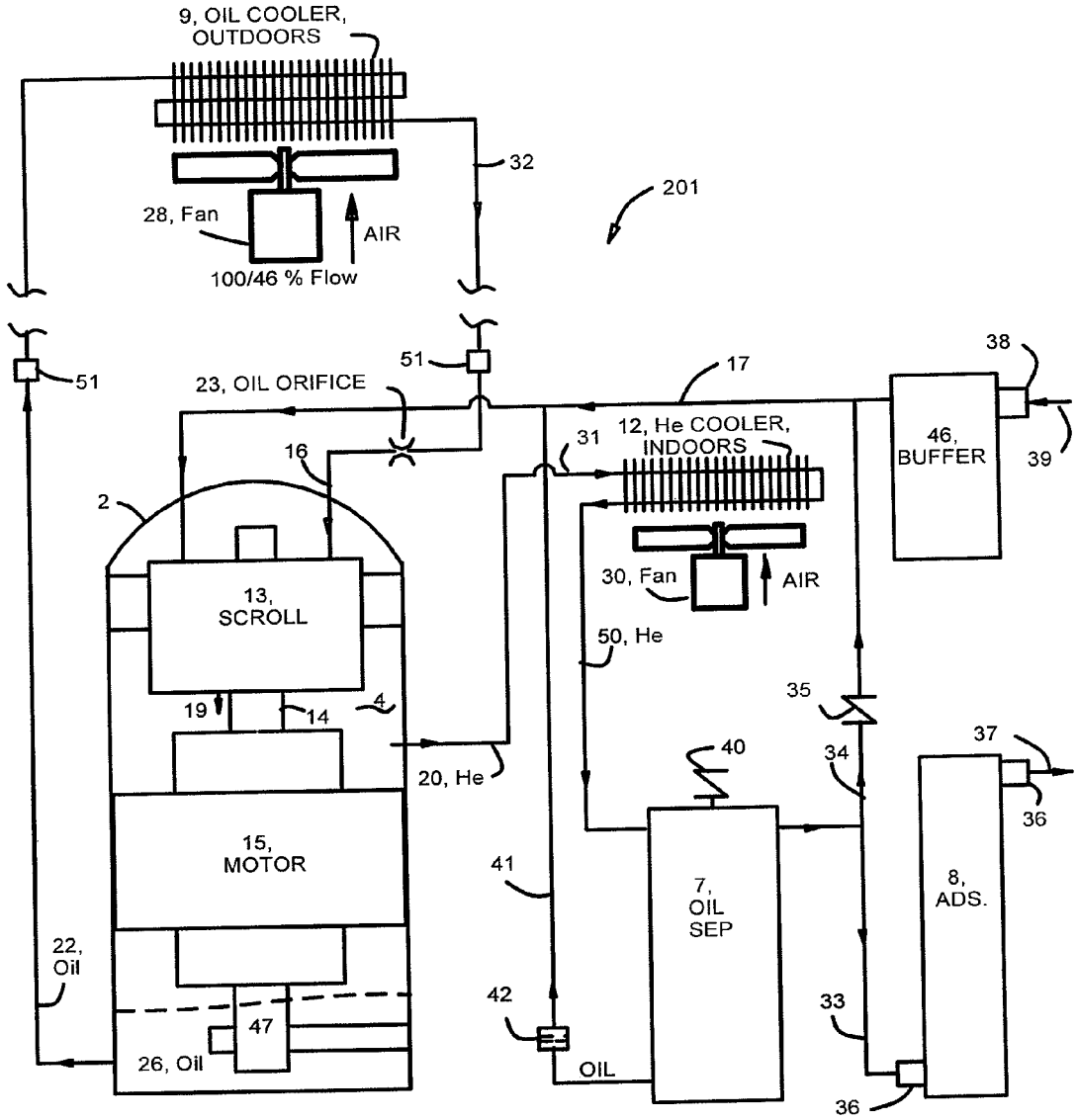
FIG. 2B is a schematic of a variation of FIG. 2A in which heat exchanger 11 is omitted.

FIG. 2B is a schematic of a variation of FIG. 2A in which heat exchanger 11 is omitted. Table 1 lists temperatures for system 201 that are comparable to system 200. System 201 rejects 66% of the heat outdoors, 34% indoors, on the hottest day assumed, and 70% of the heat outdoors, 30% indoors, on the coldest day assumed. For the 8.0 kW of input power used in this example the maximum heat load on the air conditioning system is 2.7 kW. System 201 illustrates that the cost savings of not having heat exchanger 11 are offset by significantly higher indoor heat loads on the air conditioning system.

Figure 3A:
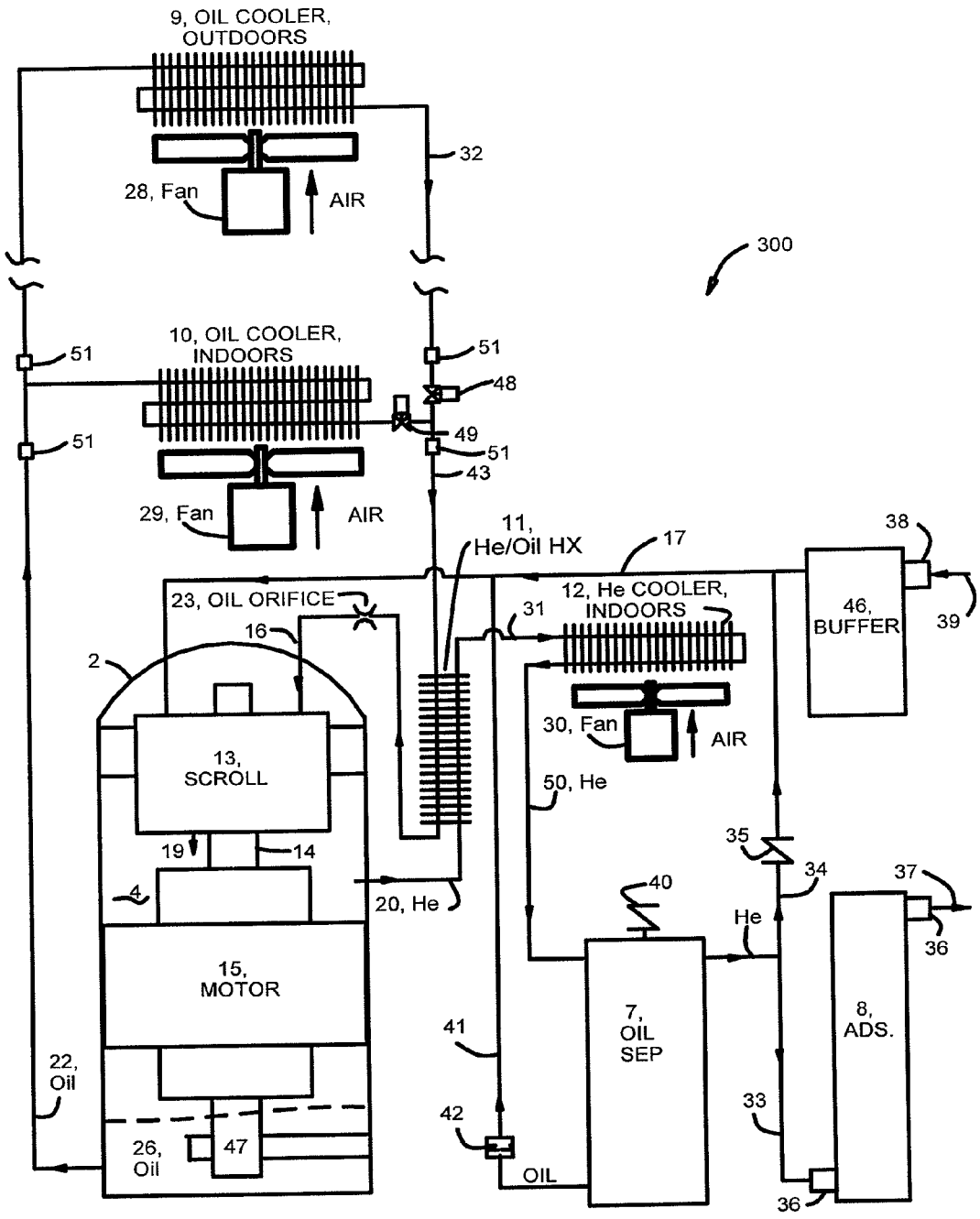
FIG. 3A is a schematic diagram of a compressor system which shows the option of adding a second air cooled oil-cooler 10 and fan 29 which are mounted indoors. Solenoid valves 48 and 49 are used to circulate the hot oil to outdoor oil-cooler 9 during the summer or indoor oil-cooler 10 during the winter.

FIG. 3A is a schematic diagram of compressor system 300 which shows the option of adding a second air cooled oil-cooler 10 and fan 29 which are mounted indoors. Solenoid valves 48 and 49 are used to circulate the hot oil to outdoor oil-cooler 9 during the summer or indoor oil-cooler 10 during the winter. Gas line couplings 51, which would typically be self sealing, enable this subassembly to be sold as an option. During the summer, solenoid valve 48 is open while 49 is closed so, the temperatures are the same as system 200. During the winter oil flows through oil-cooler 10 which is indoors so all of the heat from the compressor heats the interior space.

Figure 3B:
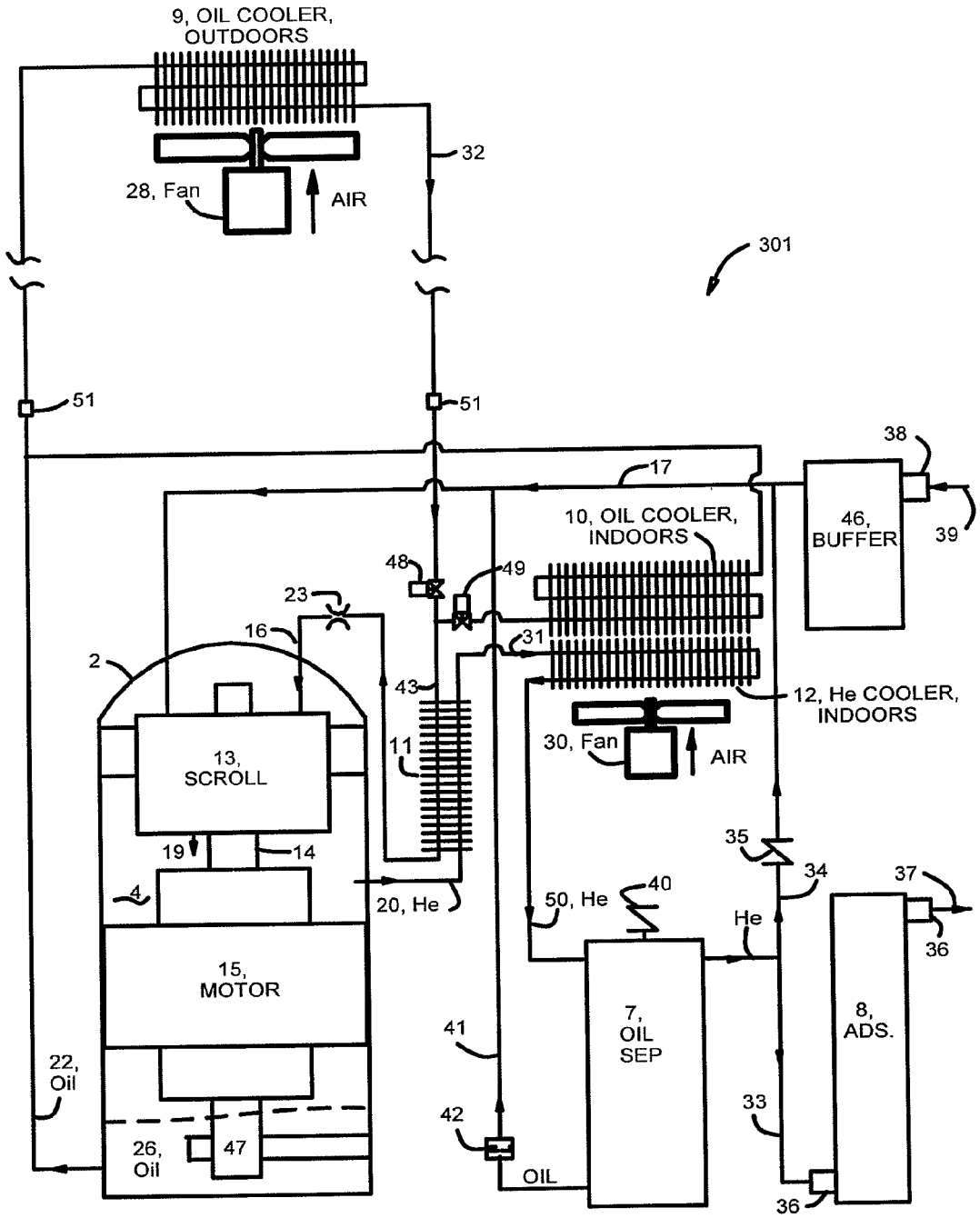
FIG. 3B is similar to FIG. 3A except that oil-cooler 10 is mounted with helium-cooler 12 and shares the same fan 30.

FIG. 3B shows compressor system 301 which is similar to FIG. 3A except that oil-cooler 10 is mounted with helium-cooler 12 and shares the same fan 30.

Figure 4:
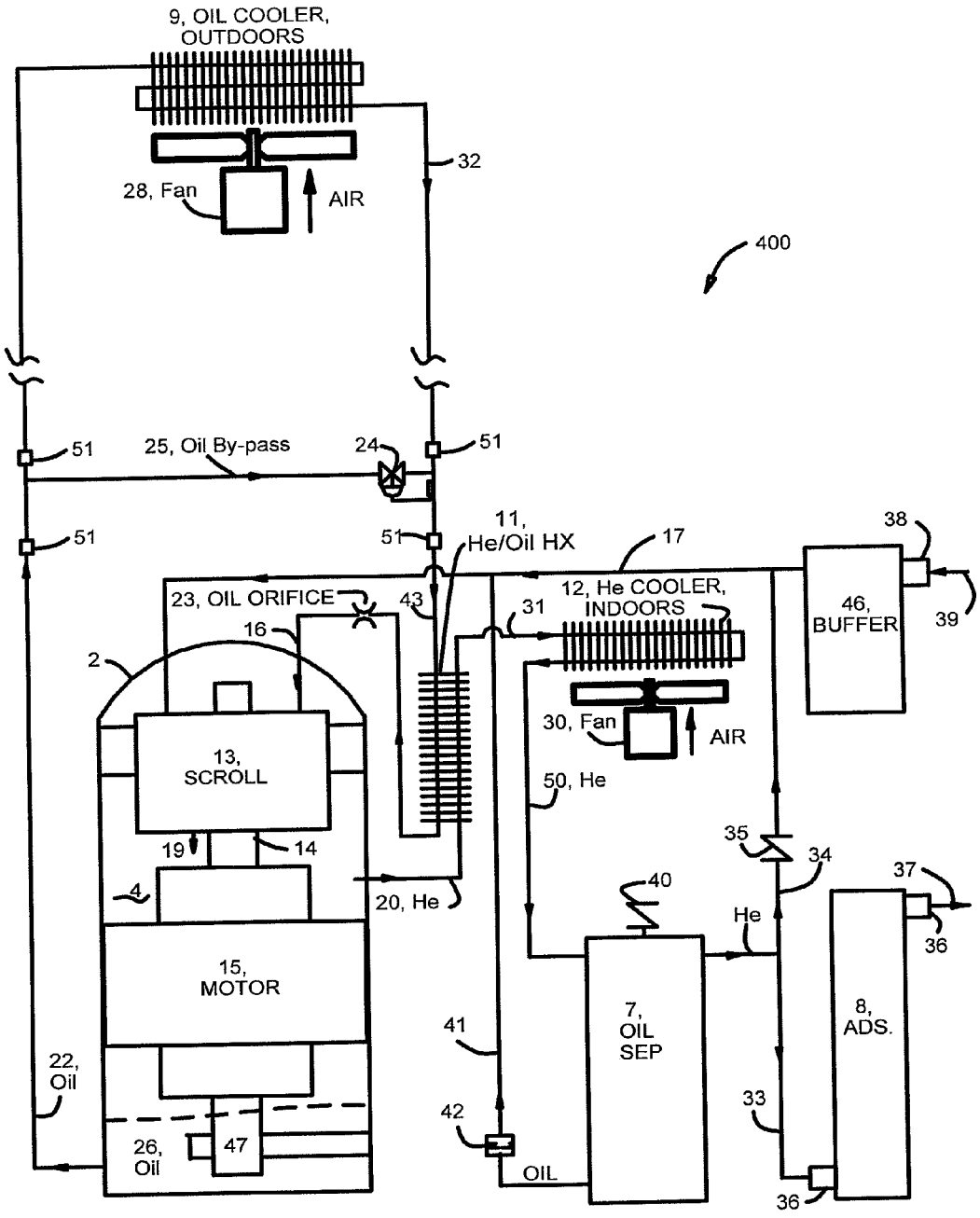
FIG. 4 shows a system similar to FIG. 2A with the addition of by-pass line 25 and oil temperature regulator 24. When the outside air temperature is very low, regulator 24 allows hot oil to flow through by-pass line 25 to mix with cold oil from oil-cooler 9 and maintain a return temperature greater than about 10° C.

FIG. 4 shows compressor system 400 which is similar to FIG. 2A with the addition of by-pass line 25 and oil temperature regulator 24. When the outside air temperature is very low, regulator 24 allows hot oil to flow through the by-pass line to mix with cold oil from oil cooler 9 and maintain a return temperature greater than about 10° C. System 400 might have an advantage over system 200 in being able to start faster in the winter. Rather than waiting for a heater to warm the oil in outdoor cooler 9, oil by-pass line 25 in system 400 can circulate oil immediately and cold oil from outside can mix while the compressor is warming up. It may be desirable to leave fan 28 off initially.

It is within the scope of this invention to replace air cooled He Cooler 12 with a water cooled heat exchanger. Nothing herein is meant to limit the present invention. It is understood that the present invention may be used with other horizontal scroll compressors or other compressors such as screw, reciprocating, centrifugal, and rotary vane types, as well as the compression of any monatomic gas. Helium/oil heat exchanger 11 is optional in any of the systems.

While this invention has been described, it will be understood that it is capable of further modification, uses and/or adaptations, following in general the principal of the invention, and including such departures from the present disclosure as come within known or customary practice in the art to which the invention pertains, and as may be applied to the essential features herein before set forth, as fall within the scope of the invention or the limits of the appended claims. Also, it is to be understood that the phraseology and terminology employed herein, as well as the abstract, are for the purpose of description and should not be regarded as limiting.

It is also understood that the following claims are intended to cover all of the generic and specific features of the invention described herein.

What is claimed is:

1. A compressor system comprising:

a compressor located in a first ambient environment and compressing a monatomic gas and a lubrication oil, the compressor producing heat;

an adsorber located in the first ambient environment, the adsorber cleaning residual lubrication oil from the monoatomic gas;

a gas-to-air heat exchanger and a first air circulator adjacent to the gas-to-air heat exchanger, each of the gas-to-air heat exchanger and the first air circulator located in the first ambient environment for cooling the monoatomic gas, the gas-to-air heat exchanger rejecting a first portion of the heat from the compressor into the first ambient environment;

an oil-to-air heat exchanger and a second air circulator adjacent to the oil-to-air heat exchanger, each of the oil-to-air heat exchange and the second air circulator located in a second ambient environment for cooling the lubrication oil, the second ambient environment being, distinct from the first ambient environment, the oil-to-air heat exchanger rejecting a second portion of the heat from the compressor to ambient air disclosed in second ambient environment, the second ambient environment having an air temperature between −30 to 45 degrees C.;

a first plurality of lines for transmitting the gas from the compressor to the gas-to-air heat exchanger and returning it from the gas-to-air heat exchanger to the compressor;

a second plurality of lines for transmitting the oil from the compressor to the oil-to-air heat exchanger and returning it from the oil-to-air heat exchanger to the compressor;

wherein the second portion of the heat is greater than the first portion of the heat;

wherein the first ambient environment is air conditioned between 15 to 30 degrees C.

2. A compressor system in accordance with claim 1, further comprising a second oil-to-air heat exchanger that is located in the first ambient environment, oil flow being diverted from the first oil-to-air heat exchanger to the second oil-to-air heat exchanger when the first ambient environment is being heated.

3. A compressor system in accordance with claim 2, in which the second oil-to-air heat exchanger has one of a fan that is different than a fan cooling the gas or the same.

4. A compressor system in accordance with claim 1, further comprising a gas-to-oil heat exchanger, the gas-to-oil heat exchanger transferring heat from the gas leaving the compressor to heat the oil returning from the oil-to-air heat exchanger and to pre-cool the gas transmitted to the gas-to-air heat exchanger from the compressor.

5. A compressor system in accordance with claim 1, further comprising an oil by-pass line and a by-pass flow regulator that connects a hot oil line from the compressor going to the oil-to-air heat exchanger with a cooled oil return line, the by-pass flow regulator controlling a temperature of a mixed oil to be greater than 10 degrees C. when it is colder in the second ambient environment.

6. A compressor system comprising:

a compressor located in a first ambient environment maintained at a temperature between 15 and 30 degrees C. and compressing a monatomic gas and lubrication oil, the compressor producing heat;

an adsorber located in the first ambient environment, the adsorber cleaning residual lubrication oil from the monoatomic gas;

a gas-to-water heat exchanger located in the first ambient environment for cooling the monoatomic gas, the gas-to-water heat exchanger rejecting a first portion of the heat from the compressor into cooling water;

an oil-to-air heat exchanger and an air circulator adjacent to the oil-to-air heat exchanger, each of the oil-to-air heat exchange and the air circulator located in a second ambient environment for cooling the lubrication oil, the second ambient environment being distinct from the first ambient environment, the oil-to-air heat exchanger rejecting a second portion of the heat from the compressor to the second ambient environment;

a first plurality of lines for transmitting the gas from the compressor to the gas-to-water heat exchanger and returning it from the gas-to-water heat exchanger to the compressor;

a second plurality of lines for transmitting the oil from the compressor to the oil-to-air heat exchanger and returning it from the oil-to-air heat exchanger to the compressor;

wherein the second portion of the heat is greater than the first portion of the heat.

7. A compressor system in accordance with claim 6, further comprising a second oil-to-air heat exchanger that is located in the first ambient environment, oil flow being diverted from the first oil-to-air heat exchanger to the second oil-to-air heat exchanger when the first ambient environment is being heated.

8. The compressor system of claim 1, wherein the first portion of the heat is less than half of the heat produced by the compressor.

9. The compressor system of claim 6, wherein the first portion of the heat is less than half of the heat produced by the compressor.

10. A method of minimizing the amount of heat rejected to a first ambient environment of an indoor air conditioned space from a compressor located in the first ambient environment, a compressor system comprising:

a compressor located in the first ambient environment and compressing a monatomic gas and a lubrication oil, the compressor producing heat;

an adsorber located in the first ambient environment, the adsorber cleaning residual lubrication oil from the monoatomic gas;

a gas-to-air heat exchanger and a first air circulator adjacent to the gas-to-air heat exchanger, each of the gas-to-air heat exchange and the first air circulator located in the first ambient environment for cooling the monoatomic gas, the gas-to-air heat exchanger rejecting a first portion of the heat from the compressor into the first ambient environment;

an oil-to-air heat exchanger and a second air circulator adjacent to the oil-to-air heat exchanger, each of the oil-to-air heat exchangers and the second air circulator located in a second ambient environment for cooling the lubrication oil, the oil-to-air heat exchanger rejecting a second portion of the heat from the compressor to ambient air in the second ambient environment, the second ambient environment being distinct from the first ambient environment, the second ambient environment having an air temperature is between −30 to 45 degrees C.;

a first plurality of lines for transmitting the gas from the compressor to the gas-to-air heat exchanger and returning it from the gas-to-air heat exchanger to the compressor;

a second plurality of lines for transmitting the oil from the compressor to the oil-to-air heat exchanger and returning it from the oil-to-air heat exchanger to the compressor;

wherein the second portion of the heat is greater than the first portion of the heat;

wherein the first ambient environment is air conditioned between 15 to 30 degrees C.;

the method comprising the steps of:

circulating gas from the compressor through the gas-to-air heat exchanger, and circulating oil from the compressor through the oil-to-air heat exchanger.

11. A method in accordance with claim 10, wherein the compressor system further comprises:

a heat exchanger that transfers heat from the oil returning from the oil to air heat exchanger to gas leaving the compressor;

the method further comprises the steps of:

passing oil through the oil to gas heat exchanger in a counter-flow relationship with the gas.

* * * * *